United States Patent [19]

Fournier et al.

[11] Patent Number: 4,550,777

[45] Date of Patent: Nov. 5, 1985

[54] SYSTEM FOR INTERLOCKING CLOSELY AJACENT VERTICAL LENGTHS OF TUBE IN A HEAT EXCHANGER HAVING LOOPS

[75] Inventors: Jean Fournier; Henri Patron, both of Rochefort en Yvelines; Paul Meynard, Verrieres le Buisson, all of France

[73] Assignee: Stein Industrie, France

[21] Appl. No.: 673,052

[22] Filed: Nov. 19, 1984

[30] Foreign Application Priority Data

Nov. 25, 1983 [FR] France ..... 83 18815

[51] Int. Cl.[4] ..... F28F 9/00

[52] U.S. Cl. ..... 165/162; 122/510; 165/172

[58] Field of Search ..... 165/172, 162; 122/510

[56] References Cited

U.S. PATENT DOCUMENTS

| | | | |
|---|---|---|---|
| 2,477,950 | 8/1949 | Bailey | 165/162 X |
| 2,757,649 | 8/1956 | Coughlin | 122/510 X |
| 2,809,616 | 10/1957 | Black | 122/478 |
| 2,834,324 | 5/1958 | Schoessow | 122/510 X |
| 2,916,263 | 12/1959 | Godshalk | 122/510 X |
| 2,997,069 | 8/1961 | Bisbee | 122/510 X |
| 3,055,349 | 9/1962 | Hamilton et al. | 122/510 |
| 3,434,531 | 3/1969 | Hochmuth et al. | 165/162 X |

*Primary Examiner*—Sheldon J. Richter

*Attorney, Agent, or Firm*—Sughrue, Mion, Zinn, Macpeak, and Seas

[57] ABSTRACT

A system for interlocking closely adjacent verical lengths (10, 11, FIG. 2) of tube in a heat exchanger in which the tubes form loops between an inlet and an outlet and in which the tubes are suspended from a rigid structure by said inlet and outlet. Starting from the middle lengths, each length is provided with a hollow member (12) projecting on its side towards the outside of the bundle, welded to the tube along two generator lines (14, 24), and resting against the outer face of the adjacent length, and including a downwardly projecting lip (18), while the adjacent length is provided with an opposite like member (13) likewise welded thereto along two generator lines (15, 25), pressing against the outer face of the first length below the first member, and fitted with an upwardly projecting lip (19) engaging with the lip of the first member.

2 Claims, 4 Drawing Figures

3
4
1
2
9
5
6
7
8

SYSTEM FOR INTERLOCKING CLOSELY AJACENT VERTICAL LENGTHS OF TUBE IN A HEAT EXCHANGER HAVING LOOPS

The present invention relates to a system for interlocking closely adjacent vertical lengths of tube in a heat exchanger in which the tubes form loops between an inlet and an outlet and in which the tubes are suspended from a rigid structure by said inlet and outlet.

BACKGROUND OF THE INVENTION

In such heat exchangers, the weight of the lengths of tube disposed in the middle portions would cause deformation if the weight were not transferred to the outer lengths which are connected to the inlet or the outlet. Proposals have already been made to transfer the weight by rigidly interlocking together all of the lengths of tube in a top zone by means of small round or square members welded between the lengths. In addition to the weight of the tubes, this rigid assembly is subjected to stresses due to:

differences in expansion between different loops since their average temperatures are different because the fluid flowing along the tubes from the inlet to the outlet is being heated;

vibrations that may arise in operation;

swinging phenomena of entire panels of tubes inside the combustion chamber; and weld shrinkage since the welding was performed on a rigid structure.

These stresses can lead to deformation, cracking and even breakage of some of the welds.

Proposals have been made in French patent specification No. 1 259 288 for a system of interlocking adjacent tubes in a heat exchanger, the system comprising a male member welded to one of the adjacent tubes, engaging and locking with two female members welded to the other tube.

Another proposal has been made in U.S. Pat. 2 809 616 for a system of interlocking adjacent tubes in a heat exchanger, the system comprising three junction members on each side of the two adjacent tubes, the middle member being welded to one of the tubes and the other two being placed respectively above and below the middle member and being welded to the other tube. These members are joined by a vertical pin passing therethrough.

Such systems are relatively complex. In the case of French specification No. 1 259 288 they require different complex shaped parts, and in the case of U.S. Pat. No. 2 809 616 a total of eight parts and six welds are required.

Preferred embodiments of the present invention provide a system for interlocking lengths of vertical tube to transfer the weight of the middle tubes to the inlet and outlet tubes, said preferred systems not only avoid stresses that are likely to cause deformation, cracking, or breakage of the welds, they are also simple to implement and can be installed rapidly.

SUMMARY OF THE INVENTION

The present invention provides a system for interlocking closely adjacent vertical lengths of tube in a heat exchanger in which the tubes from loops between an inlet length of tube and an outlet length of tube and in which the tubes are suspended from a rigid structure by said inlet and outlet lengths of tube, the system comprising an upper hollow member and a lower hollow member located between each adjacent pair of lengths of tube, the upper hollow member being welded to a first length of tube in each adjacent pair and pressing against the other or second length of tube in the pair, and the lower hollow member being welded to the second length of tube of the pair and pressing against the first length of tube of the pair, the upper and lower hollow members being located so as to come into end-to-end contact with each other and having overlapping lips projecting towards each other such that the lip of each hollow member is received between the lip of the other hollow member and the length of tube to which the other hollow member is welded, thereby interlocking the lengths of tube of the pair, and enabling at least a portion of the weight of the first length of tube to be supported, via the interlocking hollow members, by the second length of tube of the pair, the first length of tube of each pair being chosen as that one of the two lengths of tube which is further from the corresponding supporting length of tube than the other length of tube of the pair.

Preferably each first length of tube having an upper hollow member welded thereto is in addition fitted with a stop welded below the upper hollow member and below the lowest point of the lower hollow member which is interlocked therewith, the distance between the bottom end of the lower hollow member and the stop being small enough relative to the overlapping length of the lips to prevent the interlocked hollow members from disengaging.

BRIEF DESCRIPTION OF THE DRAWINGS

An embodiment of a system for interlocking closely adjacent vertical lengths of tube is described by way of example and with reference to the accompanying drawings, in which.

MORE DETAILED DESCRIPTION

Figure 1:
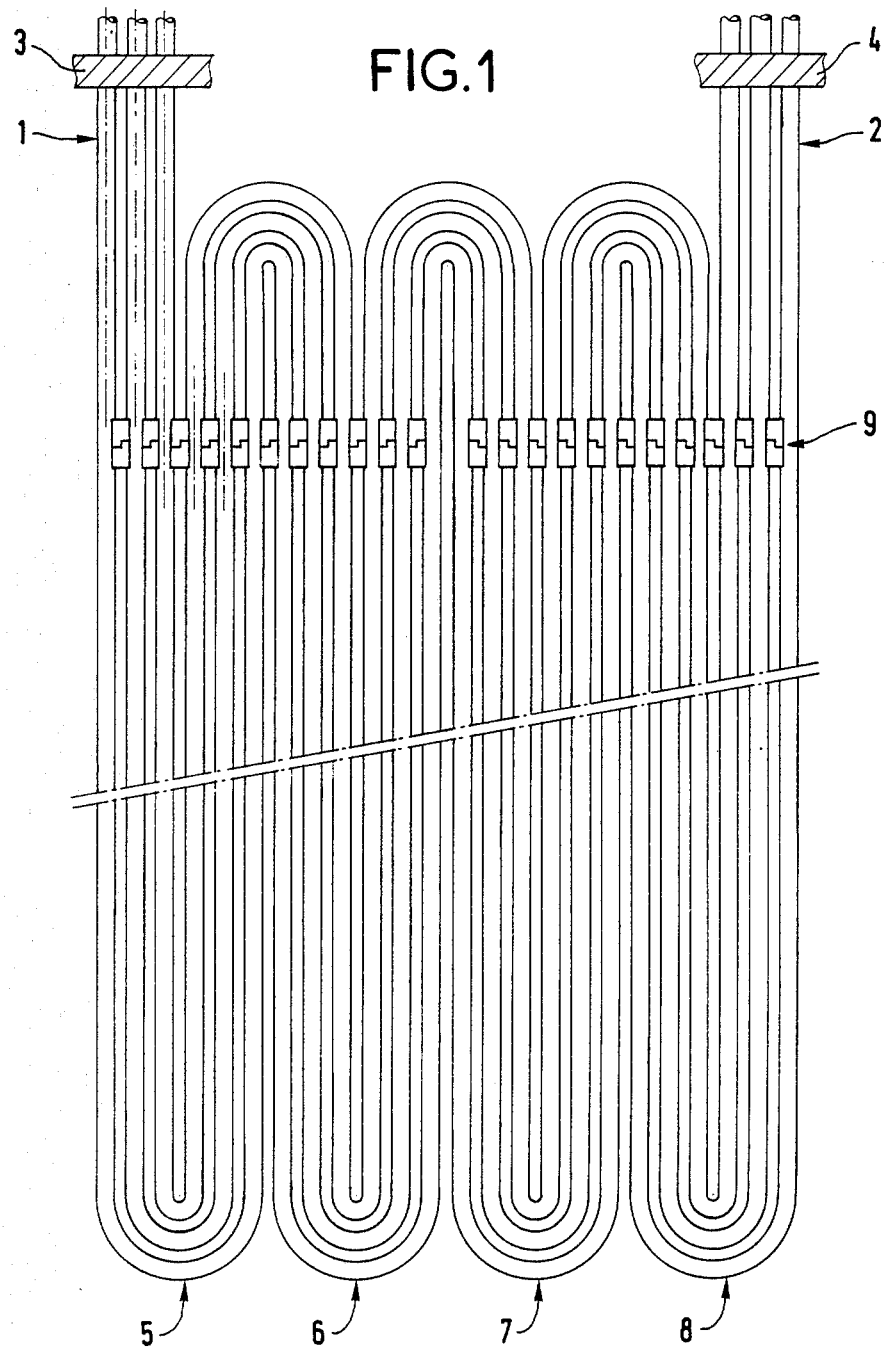
FIG. 1 is an elevation of a superheater element.

In FIG. 1, the superheater element of a steam generator comprises three tubes in parallel forming four loops 5, 6, 7, and 8. The inlet lengths of the tubes are marked 1 and are fixed to a fixed structure 3, while the outlet tubes are marked 2 and are fixed to a fixed structure 4. The interlocking system has an overall reference 9 and is disposed in the upper part of the heat exchanger. It comprises members for interlocking adjacent lengths starting from the lengths of the middle loop and going outwardly to the left and to the right in order to transfer one half of the weight of the tubes to the inlet lengths and the other half to the outlet lengths.

Figure 2:
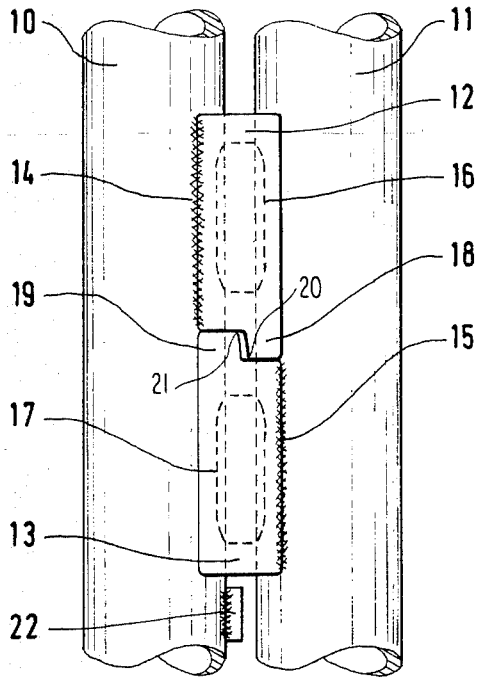
FIG. 2 is an elevation of the hollow members for interlocking two adjacent lengths, the members are welded to the tubes and are mutually engaged.
Figure 3:
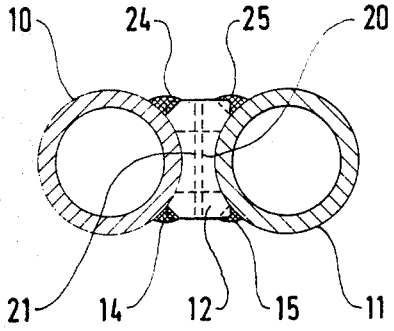
FIG. 3 shows the same members in a plan view seen from above.

FIGS. 2 and 3 are to a larger scale and show hollow members for interlocking two adjacent tubes 10 and 11.

The member 12 is welded to the length of tube 10 by weld fillets 14 and 24. Its internal oblong opening 32 comes into contact with the adjacent length 11 around an opening perimeter 16, and has a downwardly directed lip 18 which rests on the upper part of the member 13. The member 13 is welded to the length 11 by weld fillets 15 and 25. Its internal opening comes into contact with the length 10 along an opening perimeter 17, and has an upwardly directed lip 19 which presses against the lower portion of the member 12. The edges 20 and 21 of the lips 18 and 19 respectively can be seen in FIG. 3.

To avoid any possibility of the two interlocking members disengaging, a stop 22 is welded to the tube 10 is welded to the tube 10 beneath the member 13 and close enough thereto to prevent it from disengaging the member 12, given the vertical extent of the two lips 18 and 19.

Figure 4:
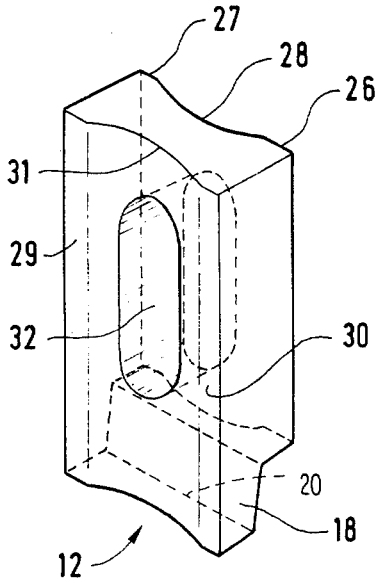
FIG. 4 is a perspective view of a hollow interlocking member.

FIG. 4 is a perspective view of an interlock member prior to being welded to a tube. It is generally rectangular in shape having: on one side, two plane edge strips 26 and 27 along which it is welded to the corresponding tube and separated by a depression 28 having a circular section of the same radius as the tubes so as to be pressed thereagainst; and on the other side two plane edge strips 29 and 30 likewise separated by a depression 31 having a circular section of the same radius so as to be pressed against the adjacent tube. In addition, it is pierced by an oblong opening 32 and is terminated at the bottom by a lip 18.

What is claimed is:

1. A system for interlocking closely adjacent vertical lengths of tubes in a heat exchanger in which each tube forms loops between an inlet length of tube and an outlet length of tube and in which tubes are suspended from a rigid structure by said inlet and outlet lengths of said tubes, said system comprising an upper hollow member and a lower hollow member located between each adjacent pair of lengths of tube, the upper hollow member being welded to a first length of tube in each adjacent pair and pressing laterally against the other or second length of tube in the pair, and the lower hollow member being welded to the second length of tube of the pair and pressing laterally against the first length of tube of the pair, the upper and lower hollow members having facing bottom and top ends, respectively, being located so as to come into end-to-end contact with each other and said upper and lower hollow members bottom and top ends having longitudinally overlapping lips projecting towards each other such that the lip of each hollow member is received between the lip of the other hollow member and the length of tube to which the other hollow member is welded, thereby laterally interlocking the lengths of tube of the pair, and enabling at least a portion of the weight of the first length of tube to be supported, via the interlocking hollow members, by the second length of tube of the pair, the first length of tube of each pair being chosen as that one of the lengths of tube which is further from the corresponding supporting length of tube than the other length of tube of the pair.

2. A system according to claim 1, wherein each first length of tube having an upper hollow member welded thereto is in addition fitted with a stop welded below a bottom end of the lower hollow member and below the lowest point of the lower hollow member which is interlocked therewtih, the distance between the bottom end of the lower hollow member and the stop being small enough relative to the overlapping length of the lips to prevent the interlocked hollow members from disengaging.

* * * * *